US012071880B1

(12) United States Patent
Bezner et al.

(10) Patent No.: US 12,071,880 B1
(45) Date of Patent: Aug. 27, 2024

(54) EXHAUST ASSEMBLIES AND VEHICLES INCLUDING AN EXHAUST ASSEMBLY

(71) Applicant: PACCAR Inc, Bellevue, WA (US)

(72) Inventors: Bruce Bezner, Lindsay, TX (US); Aaron Walterscheid, Muenster, TX (US); Kevin Walterscheid, Muenster, TX (US)

(73) Assignee: PACCAR Inc, Bellevue, WA (US)

( * ) Notice: Subject to any disclaimer, the term of this patent is extended or adjusted under 35 U.S.C. 154(b) by 0 days.

(21) Appl. No.: 18/491,519

(22) Filed: Oct. 20, 2023

(51) Int. Cl.
*F01N 13/10* (2010.01)
*F01N 1/08* (2006.01)

(52) U.S. Cl.
CPC ..... *F01N 13/102* (2013.01); *F01N 1/08* (2013.01)

(58) Field of Classification Search
CPC . F01N 1/08; F01N 1/16; F01N 13/102; F01N 13/082; F01N 13/1805; F01N 13/08; F01N 13/1811; F01N 2240/20; F01N 2240/36; F01N 2490/00; F01N 2590/08; Y02T 10/12; Y02T 10/40
See application file for complete search history.

(56) References Cited

U.S. PATENT DOCUMENTS 6,006,859 A 12/1999 Hussaini
6,470,998 B1 * 10/2002 White ..... F01N 3/06 181/239
6,962,230 B2 11/2005 Hanaya et al.
7,513,328 B2 * 4/2009 Shigeta ..... B62K 11/04 180/225
7,686,131 B1 3/2010 Osterkamp et al.
8,261,712 B2 * 9/2012 Sotiriades ..... F02M 1/10 123/179.18
8,495,995 B2 * 7/2013 Drew ..... F02M 1/10 123/179.18
8,978,622 B2 * 3/2015 Furuya ..... F02M 1/10 123/337
9,536,040 B2 1/2017 Zhang et al.
10,167,822 B2 * 1/2019 Dearth ..... F02D 19/10
2006/0242952 A1 * 11/2006 Muramatsu ..... F01N 13/008 60/299
2012/0137666 A1 6/2012 Komitsu et al.

OTHER PUBLICATIONS

Product Listing—63mm Straight Stainless Steel Car Exhaust Pipe Tip End Tail Muffler Rectangular Mesh Cover Car Exhaust Pipe Car Exhaust Tail Pipe, Date First Available Sep. 26, 2022, https://www.amazon.co.uk/Straight-Stainless-Exhaust-Muffler-Rectangular/dp/BOBGGYMQFD (6 pages).
Product Listing—Stainless Polished Chrome Muffler Exhaust Tip Tail Pipe Finisher Compatible with 2016-2020 Honda Civic, Date First Available Jul. 5, 2017, https://www.amazon.com/Stainless-Polished-Finisher-Compatible-2016-2020/dp/B073QZV62S (8 pages).

* cited by examiner

*Primary Examiner* — Dapinder Singh

(57) ABSTRACT

A vehicle includes: an engine; an exhaust pipe, fluidly coupled to the engine; a vehicle body including a fairing having an exhaust opening; and an exhaust assembly, the exhaust assembly including: an expansion chamber having a first opening fluidly coupled to the exhaust pipe and a second opening aligned with the exhaust opening in the fairing, a cross-sectional area of the second opening being greater than a cross-sectional area of the first opening, and a choke plate attached to the expansion chamber and shaped and sized to cover at least ten percent of the cross-sectional area of the second opening.

20 Claims, 6 Drawing Sheets

EXHAUST ASSEMBLIES AND VEHICLES INCLUDING AN EXHAUST ASSEMBLY

BACKGROUND

Vehicles that include fuel-burning engines, such as gasoline or diesel engines, produce exhaust gas that must be expelled from the vehicle. However, the exhaust gas generally has a very high temperature that can cause complications or damage to the vehicle if it is not carefully directed from the engine to the exterior of the vehicle. For example, if the exhaust gas is expelled under the chassis (e.g., expelled toward the ground below the vehicle), the exhaust gas can raise the temperature in the vehicle's tires and in other temperature-sensitive components under the vehicle's chassis to unsafe or undesirable levels. On the other hand, if the exhaust gas is simply expelled through an exhaust opening in the exterior fairing of the vehicle, heat from the exhaust gas can damage the fairing and cause undesirable discoloration of the fairing paint. It is in view of this technical environment that aspects of the present disclosure are directed.

This background section is provided only for purposes of introducing certain background material relating to the present disclosure and, thus, is not an admission of prior art.

SUMMARY

This Summary section introduces some features of nonlimiting and non-exhaustive examples of the present disclosure, and is not intended to limit the scope of the claims.

In some examples, the technology relates to a vehicle, including: an engine; an exhaust pipe, fluidly coupled to the engine; a vehicle body including a fairing having an exhaust opening; and an exhaust assembly, the exhaust assembly including: an expansion chamber having a first opening fluidly coupled to the exhaust pipe and a second opening aligned with the exhaust opening in the fairing, a cross-sectional area of the second opening being greater than a cross-sectional area of the first opening, and a choke plate attached to the expansion chamber and shaped and sized to cover at least ten percent of the cross-sectional area of the second opening.

In some examples, the choke plate has a planar geometry extending over the second opening. In some examples, the choke plate is positioned entirely outside of the expansion chamber. In some examples, the choke plate has an opening aligned with, and having a shape generally corresponding to, the exhaust opening in the fairing. In some examples, the fairing covers at least part of an outer edge of the choke plate. In some examples, the exhaust assembly is separated from the fairing by a gap. In some examples, the exhaust assembly further includes a thermal barrier between the choke plate and the expansion chamber. In some examples, the exhaust assembly further includes a grill plate spanning across the second opening.

In some examples, the technology relates to a vehicle, including: an engine; an exhaust pipe, fluidly coupled to the engine; a vehicle body including a fairing having an exhaust opening; and an exhaust assembly, the exhaust assembly including: an expansion chamber having a first opening coupled to the exhaust pipe and a second opening aligned with the exhaust opening in the fairing, a cross-sectional area of the second opening being greater than a cross-sectional area of the first opening, a grill plate spanning across the second opening, and a choke plate attached to the expansion chamber and shaped and sized to cover at least part of the second opening.

In some examples, the choke plate has a planar geometry extending over the second opening, and is entirely outside of the expansion chamber. In some examples, the choke plate has an opening aligned with, and having a shape generally corresponding to, the exhaust opening in the fairing. In some examples, the fairing covers at least part of an outer edge of the choke plate. In some examples, the exhaust assembly is separated from the fairing by a gap. In some examples, the exhaust assembly further includes a thermal barrier between the choke plate and the expansion chamber.

In some examples, the technology relates to an exhaust assembly for a vehicle, the exhaust assembly including: an expansion chamber having a first opening configured to be coupled to an exhaust pipe and a second opening having a cross-sectional area that is greater than a cross-sectional area of the first opening; a choke plate attached to the expansion chamber and shaped and sized to cover at least part of the second opening; and a thermal barrier layer between the choke plate and the expansion chamber.

In some examples, the choke plate covers at least ten percent of the cross-sectional area of the second opening, and the choke plate has an opening exposing the remainder of the cross-sectional area of the second opening. In some examples, the thermal barrier layer is shaped and sized to cover at least part of the second opening. In some examples, the exhaust assembly further includes a grill plate spanning across the second opening. In some examples, the second opening of the expansion chamber has a quadrangular shape. In some examples, the choke plate has a planar geometry extending over the second opening, and is positioned entirely outside of the expansion chamber.

BRIEF DESCRIPTION OF THE DRAWINGS

The drawings, together with the specification, illustrate nonlimiting and non-exhaustive examples of the present disclosure.

DETAILED DESCRIPTION

Figure 1A:
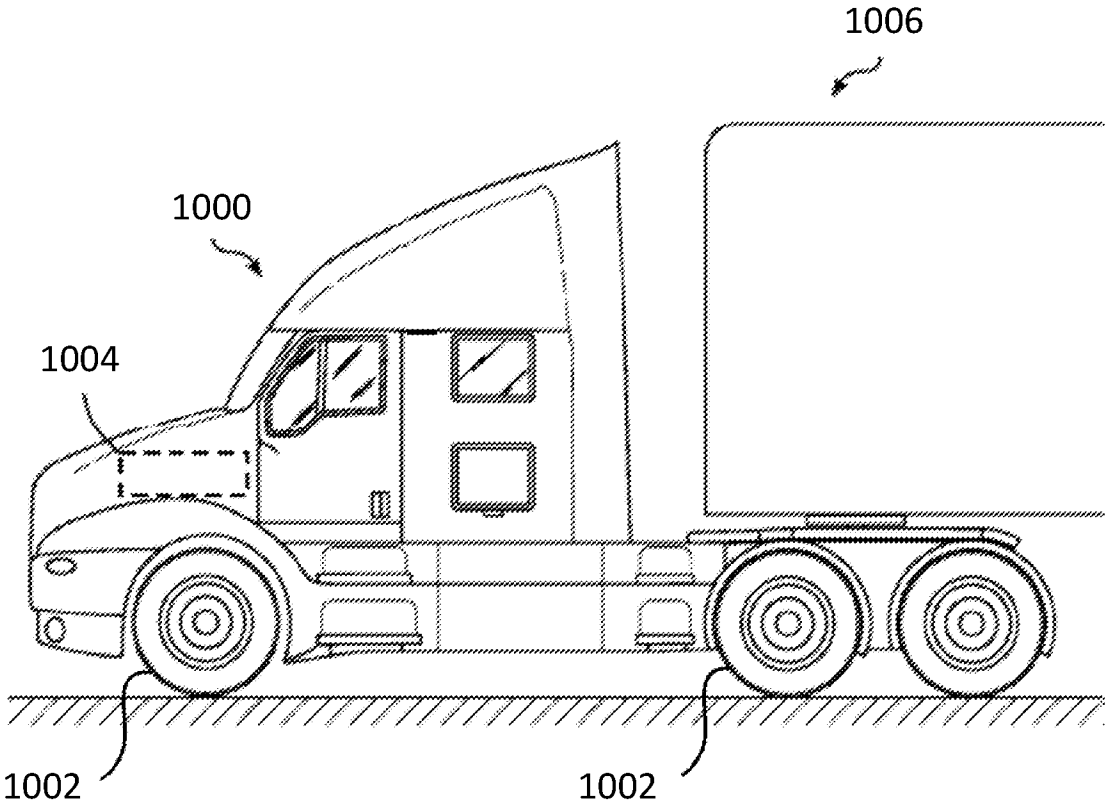
FIG. 1A depicts a side view of a vehicle according to some examples.

Nonlimiting and non-exhaustive examples of exhaust assemblies and vehicles including exhaust assemblies will now be described in more detail.

It will be understood that, although the terms "first", "second", "third", etc., may be used herein to describe various elements and features, these elements and features should not be limited by these terms. These terms are only used to distinguish one element or feature from another element or feature. Thus, a first element or feature discussed below could be termed a second element or feature, without departing from the spirit and scope of the present disclosure.

The terminology used herein is for the purpose of describing particular examples only and is not intended to be limiting of the present disclosure. As used herein, the singular forms "a", "an" and "the" are intended to include the plural forms as well, unless the context clearly indicates otherwise. It will be further understood that the terms "comprises," "comprising," "includes," and "including," when used in this specification, specify the presence of stated elements and/or features, but do not preclude the presence or addition of one or more other elements and/or features.

As used herein, the term "and/or" includes any and all combinations of one or more of the associated listed items. Expressions such as "at least one of," when preceding a list of elements, modify the entire list of elements and do not modify the individual elements of the list. Further, the use of "may" when describing examples of the present disclosure refers to "one or more examples of the present disclosure."

It will be understood that when an element or layer is referred to as being "on", "coupled to", "attached to", or "adjacent to" another element or layer, it can be directly on, directly coupled to, directly attached to, or immediately adjacent to, the other element or layer, or one or more intervening elements or layers may be present. In contrast, when an element or layer is referred to as being "directly on," "directly coupled to", "directly attached to", or "immediately adjacent to" another element or layer, there are no intervening elements or layers present.

Also, any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein.

Figure 1B:
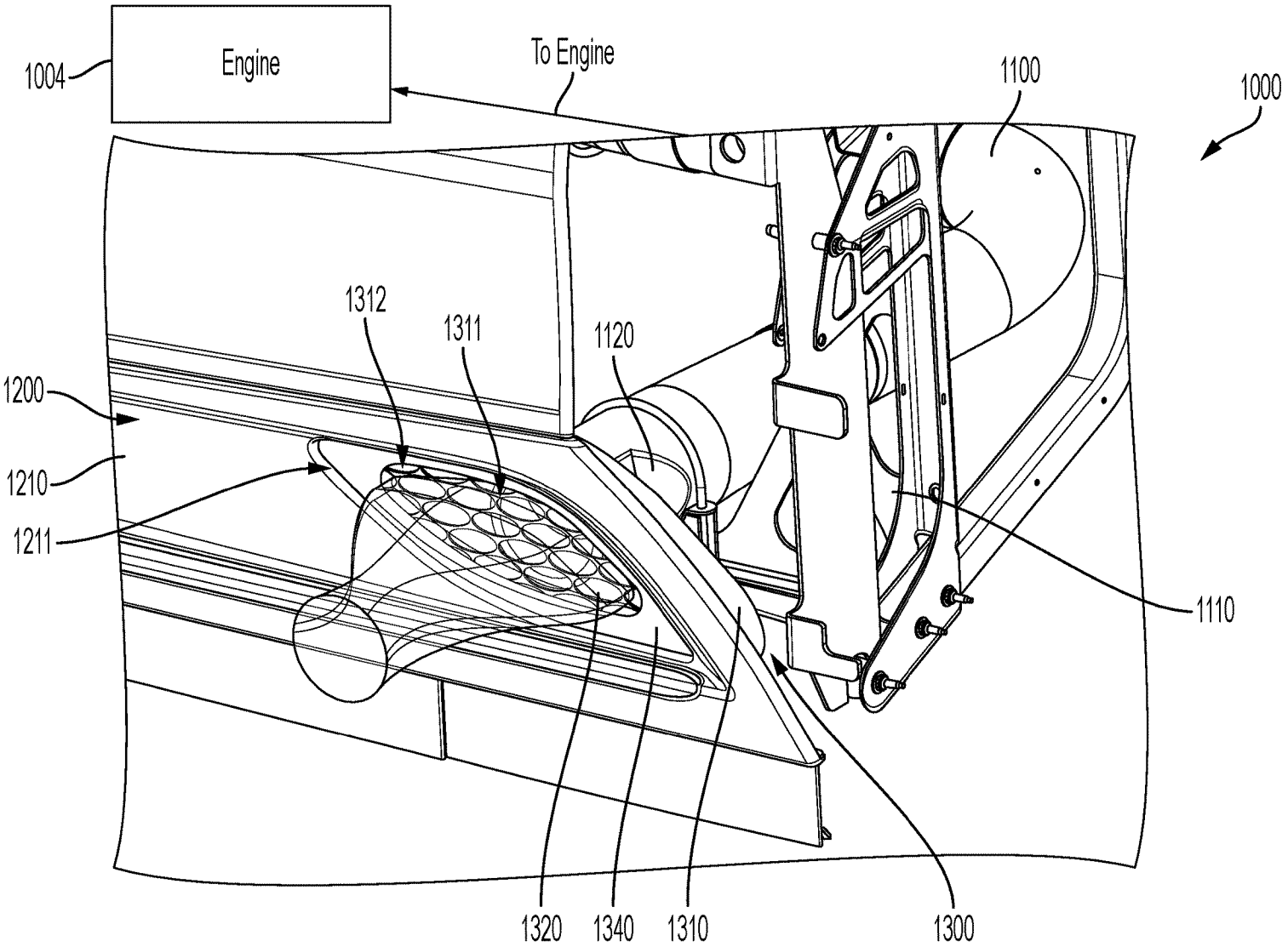
FIG. 1B depicts part of an exterior of the vehicle, and part of an interior of the vehicle.
Figure 2:
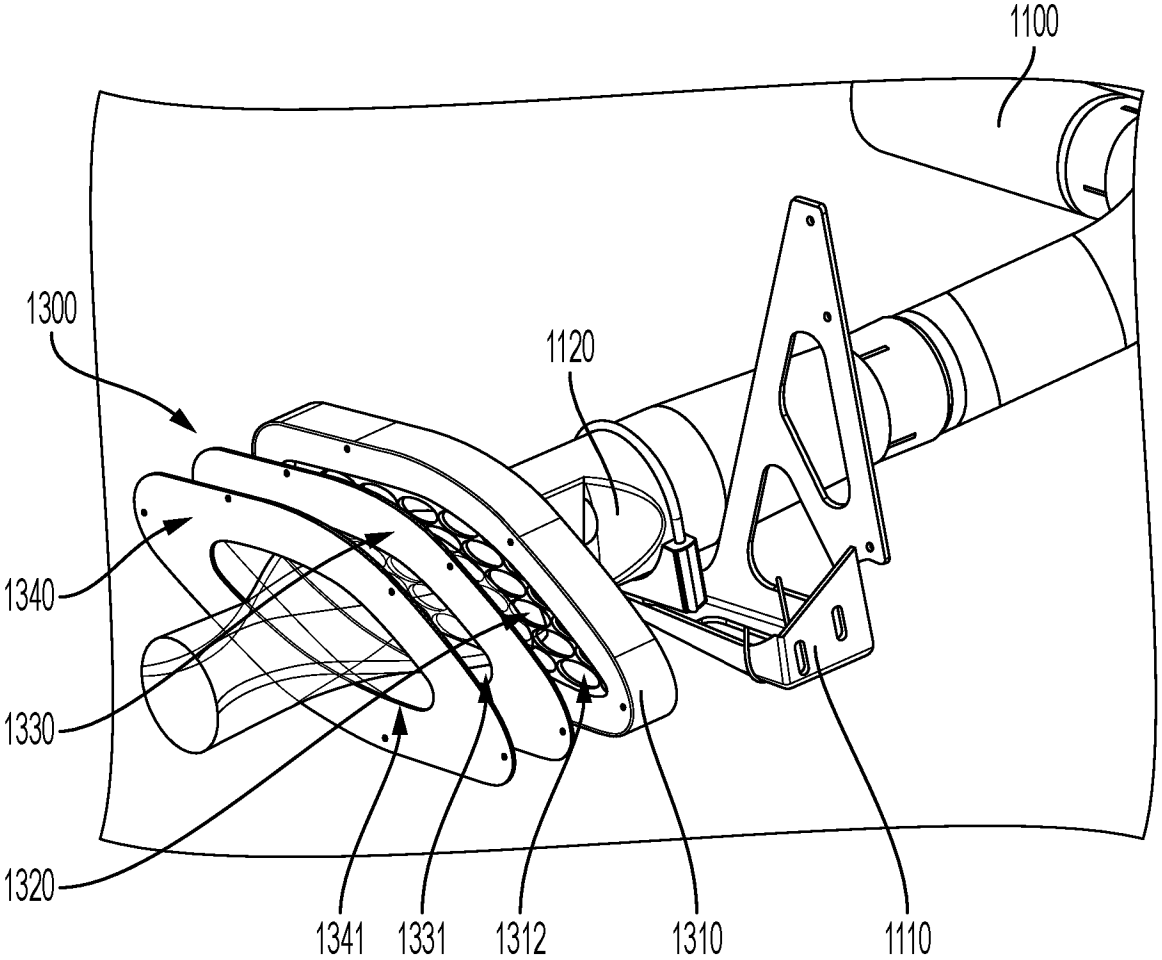
FIG. 2 depicts a partially exploded perspective view of an exhaust assembly of the vehicle of FIG. 1.
Figure 3:
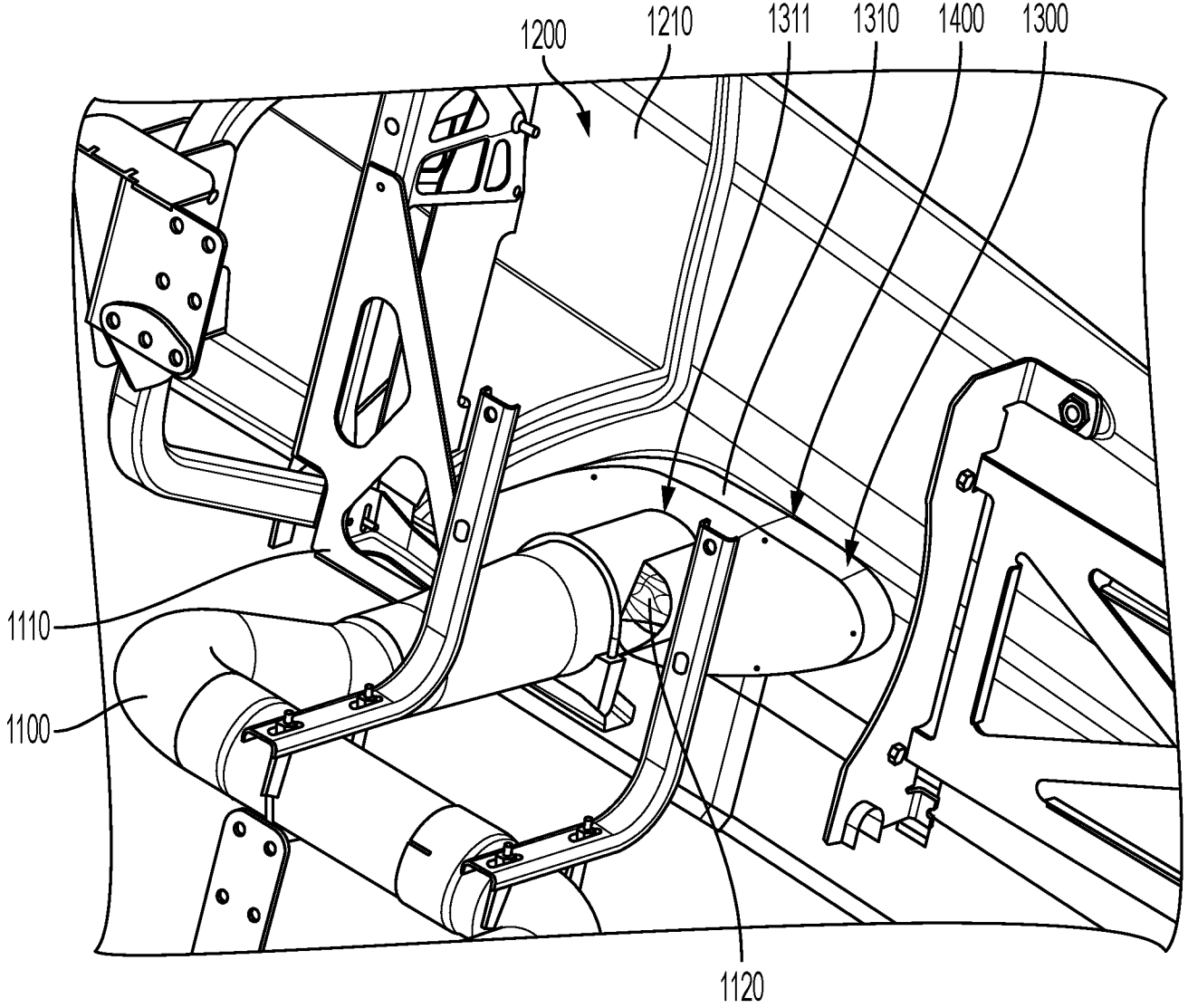
FIG. 3 depicts a view from an interior of the vehicle of FIG. 1.

FIG. 1A depicts a side view of a vehicle 1000 according to some examples. FIG. 1B depicts part of an exterior of the vehicle 1000, and part of an interior of the vehicle 1000. FIG. 2 depicts a partially exploded perspective view of an exhaust assembly 1300 of the vehicle 1000 of FIG. 1A. FIG. 3 depicts a view from an interior of the vehicle 1000 of FIG. 1A.

Referring concurrently to FIGS. 1A-3, the vehicle 1000 may be any suitable type of vehicle and may be of different types and/or sizes. In the depicted example, the vehicle 1000 is a truck, for example, a Class 8 truck. However, aspects of the disclosed subject matter may have wide application and, therefore, may be suitable for use with other types of vehicles, such as passenger vehicles, buses, light, medium, and heavy-duty vehicles, motor homes, etc.

The vehicle 1000 may include a chassis supported by wheels 1002, an engine 1004, an exhaust pipe 1100 fluidly coupled to the engine, and a vehicle body 1200 that includes a fairing 1210 having an exhaust opening 1211. The vehicle 1000 may be a part of a tractor-trailer combination, or a tractor-trailer system, which may include the vehicle 1000 having a so-called fifth wheel by which a box-like, flat-bed, or tanker semi-trailer 1006 (among other examples) may be attached for transporting cargo or the like. The vehicle 1000 may include a cabin from which a driver may steer the vehicle 1000. The engine (e.g., a diesel or gasoline engine) may be configured to burn (e.g., combust) fuel during normal operation and expel the exhaust gas of the burnt fuel through the exhaust pipe 1100 to the outside of the vehicle 1000. For example, the exhaust pipe 1100 may have a proximal end fluidly coupled to an exhaust manifold of the engine, and a distal end (that is, the end of the exhaust pipe farthest from the engine) that is positioned and oriented to expel the exhaust through the exhaust opening 1211 and to the outside of the vehicle 1000.

The exhaust opening 1211 may be positioned at any suitable location on the fairing 1210. For example, the exhaust opening 1211 may be at a left side, a right side, or a rear of the vehicle 1000. Positioning the exhaust opening 1211 at a left side or a right side can be advantageous for some vehicles for which it may not be desirable to expel the exhaust gas from the rear of the vehicle, such as tractor trucks that are configured for a trailer to be attached to the rear of the tractor truck.

The vehicle 1000 may include an exhaust assembly 1300 that is positioned between the exhaust pipe 1100 (e.g., the distal end of the exhaust pipe 1100) and the exhaust opening 1211. The exhaust assembly 1300 may include an expansion chamber 1310, a grill plate 1320, a thermal barrier layer 1330, and a choke plate 1340.

The expansion chamber 1310 may have a first opening 1311 configured to fluidly couple to the exhaust pipe 1100 (e.g., to the distal end of the exhaust pipe 1100) and a second opening 1312, which may be aligned with the exhaust opening 1211 when the expansion chamber 1310 is coupled to the exhaust pipe 1100. In some examples, the first and second openings 1311 and 1312 are on opposite sides of the expansion chamber 1310. For example, the first and second openings 1311 and 1312 may be aligned with each other. In some examples, at least part of the first opening 1311 is exposed (e.g., visibly exposed) by the second opening 1312.

The expansion chamber 1310 may be configured to be attached to and separated from the exhaust pipe 1100. For example, the expansion chamber 1310 is not integrally formed with the exhaust pipe 1100 in some examples, and may be attached to the distal end of the exhaust pipe 1100 during the manufacturing of the vehicle 1000.

An interior of the expansion chamber 1310 may be larger, or may expand to be larger, in terms of cross-sectional area (e.g., an area in a plane perpendicular to an exhaust flow direction) than the distal end of the exhaust pipe 1100. In some examples, a cross-sectional area of the interior of the expansion chamber 1310 at the first opening 1311 is greater than a cross-sectional area of the distal end of the exhaust pipe 1100. For example, a step increase in cross-sectional area may occur between the distal end of the exhaust pipe 1100 and the interior of the expansion chamber 1310. In some examples, the cross-sectional area of the interior of the expansion chamber 1310 may be substantially constant (e.g., within 20%, 15%, 10%, 5%, 2%, or 1% of an average cross-sectional area) between the first and second openings 1311 and 1312 of the expansion chamber 1310. The interior of the expansion chamber 1310 may be exclusive of the first and second openings 1311 and 1312.

In some examples, a cross-sectional area of the interior of the expansion chamber 1310 may increase along the exhaust flow direction and/or along a direction from the first opening 1311 toward the second opening 1312 (e.g., along a direction parallel to a shortest line extending between the first and second openings 1311 and 1312). For example, a cross-sectional area of the interior of the expansion chamber 1310 adjacent to the first opening 1311 may be substantially the same (e.g., within 10%, 5%, 2%, or 1% of being the same) as the cross-sectional area of the first opening 1311 and/or or the distal end of the exhaust pipe 1100, and the cross-sectional area of the interior of the expansion chamber 1310 may increase from the first opening 1311 along the exhaust flow direction and/or toward the second opening 1312. In some examples, the cross-sectional area of the interior of the expansion chamber 1310 adjacent to the second opening 1312 is substantially the same (e.g., within 10%, 5%, 2%, or 1% of being the same) as the cross-sectional area of the second opening 1312.

The second opening 1312 may have any shape, such as a circle, an oval, or a quadrangle (e.g., a square, a rectangle, a rhombus, a parallelogram, etc.). The first opening 1311 may have a shape and size (e.g., area) respectively corresponding to a shape and size of the distal end of the exhaust pipe 1100.

The choke plate 1340 may be attached to the expansion chamber 1310 and shaped and sized to cover at least part of the second opening 1312. For example, the choke plate 1340 may be shaped and sized to cover at least 5%, 10%, 15%, 20%, 25%, or 30% of the cross-sectional area of the second opening 1312. In some examples, the choke plate 1340 is attachable to, and detachable from, the expansion chamber 1310 (e.g., via screws, friction fit, fasteners, etc.). For example, the choke plate 1340 is not integrally formed with the expansion chamber 1310 in some examples. In some examples, the choke plate 1340 includes (e.g., is) a material that is different than the material of the expansion chamber 1310.

In some examples, the choke plate 1340 has an opening 1341 aligned with the second opening 1312 of the expansion chamber 1310 and with the exhaust opening 1211 of the fairing 1210. The opening 1341 of the choke plate 1340 may have a shape generally corresponding to a shape of the exhaust opening 1211 of the fairing 1210, and a cross-sectional area of the opening 1341 may be smaller than a cross-sectional area of the exhaust opening 1211. For example, the opening 1341 and the exhaust opening 1211 may both have a circular, oval, or quadrangular shape. In some examples, the choke plate 1340 is shaped and sized such that a shortest width between a perimeter of the opening 1341 to a perimeter defining the exhaust opening 1211 is substantially constant (e.g., within 20%, 15%, 10%, 5%, 2%, or 1% from an average width) over all points along the perimeter defining the opening 1341. The fairing 1210 may cover (e.g., visibly block or fluidly block) at least part of an outer edge of the choke plate 1340. In some examples, the shape of the opening 1341 of the choke plate 1340 is different from the shape of the second opening 1312 of the expansion chamber 1310.

The expansion chamber 1310 and the choke plate 1340 can reduce the heat flowing from the exhaust gas to the fairing 1210 for at least the following reasons. The expansion chamber 1310 allows the exhaust gas to expand to a stream having a larger cross-sectional area before being expelled through the exhaust opening 1211. This can reduce the average temperature of the exhaust gas as it moves through the exhaust opening 1211, which can reduce the amount of heat that flows from the exhaust gas to the fairing 1210. The choke plate 1340 can also provide a thermal buffer region between the opening 1341 of the choke plate 1340 and the exhaust opening 1211 of the fairing 1210. This can reduce the amount of exhaust gas that comes into contact with the fairing 1210 compared to if the choke plate 1340 were not included, which can reduce the amount of heat that flows from the exhaust gas to the fairing 1210. Additionally, by expanding the cross-sectional area that the exhaust gas can move through (via the expansion chamber 1310) and then reducing the cross-sectional area that the exhaust gas can move through (via the choke plate 1340), a nozzle effect can be provided that causes the exhaust gas to be expelled through the exhaust opening 1211 in a cone-like shape and at a higher velocity compared to if the choke plate 1340 were not included. This can control the flow of heat of the exhaust gas as it is expelled through the exhaust opening 1210 so that the temperature near the fairing 1210 is reduced compared to if the choke plate 1340 were not included.

Figure 4A:
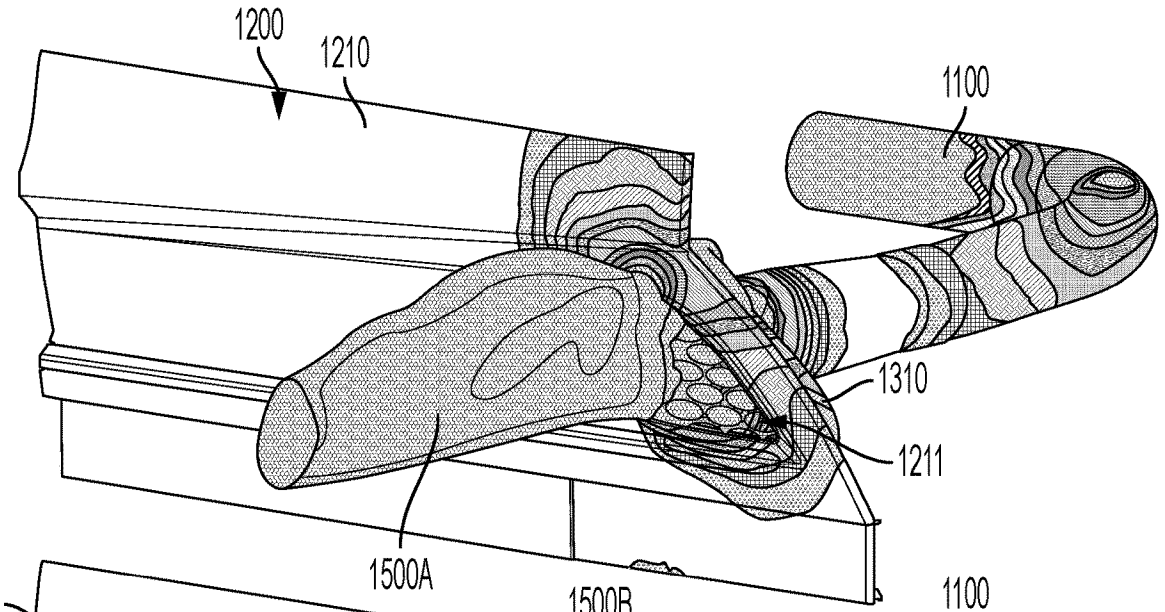
FIG. 4A depicts a simulation of an isothermal thermal surface of exhaust gas being expelled from the exhaust opening of the vehicle of FIG. 1 that includes the expansion chamber but without the choke plate.
Figure 4B:
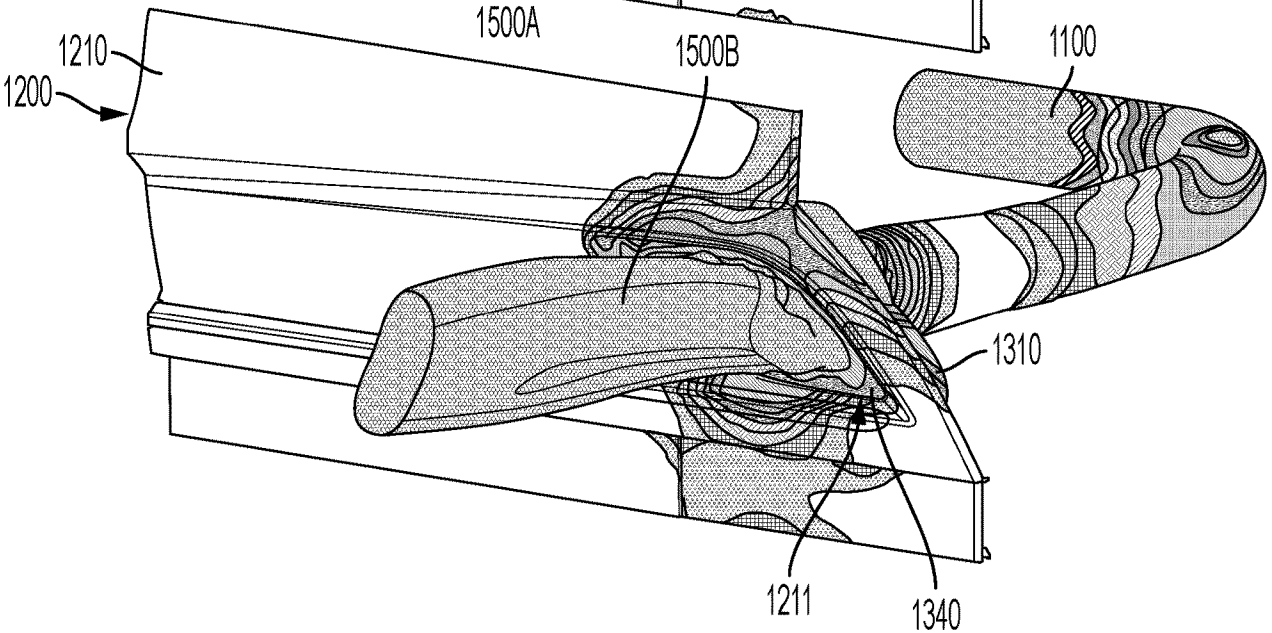
FIG. 4B depicts a simulation of an isothermal thermal surface of exhaust gas being expelled from the exhaust opening of the vehicle of FIG. 1 that includes the expansion chamber with the choke plate.
Figure 4D:
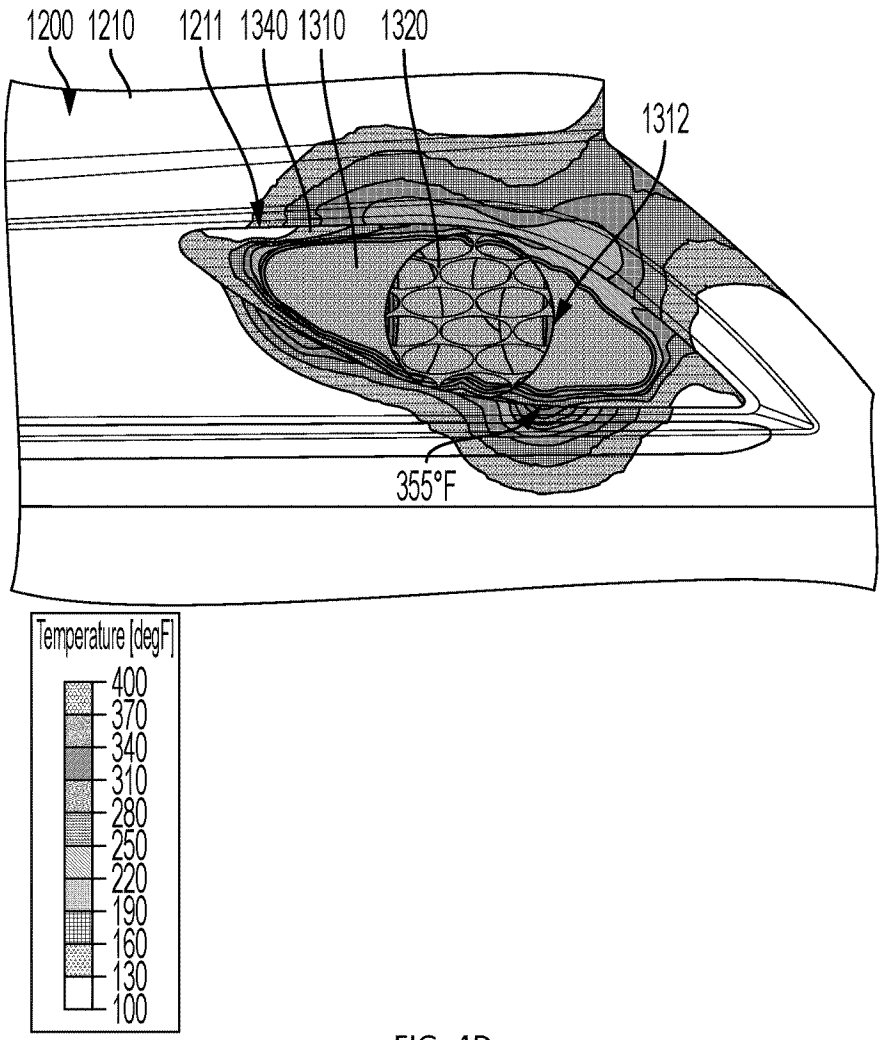
FIG. 4D depicts a heat map of the vehicle of FIG. 4B during the simulation shown in FIG. 4B.
Figure 4C:
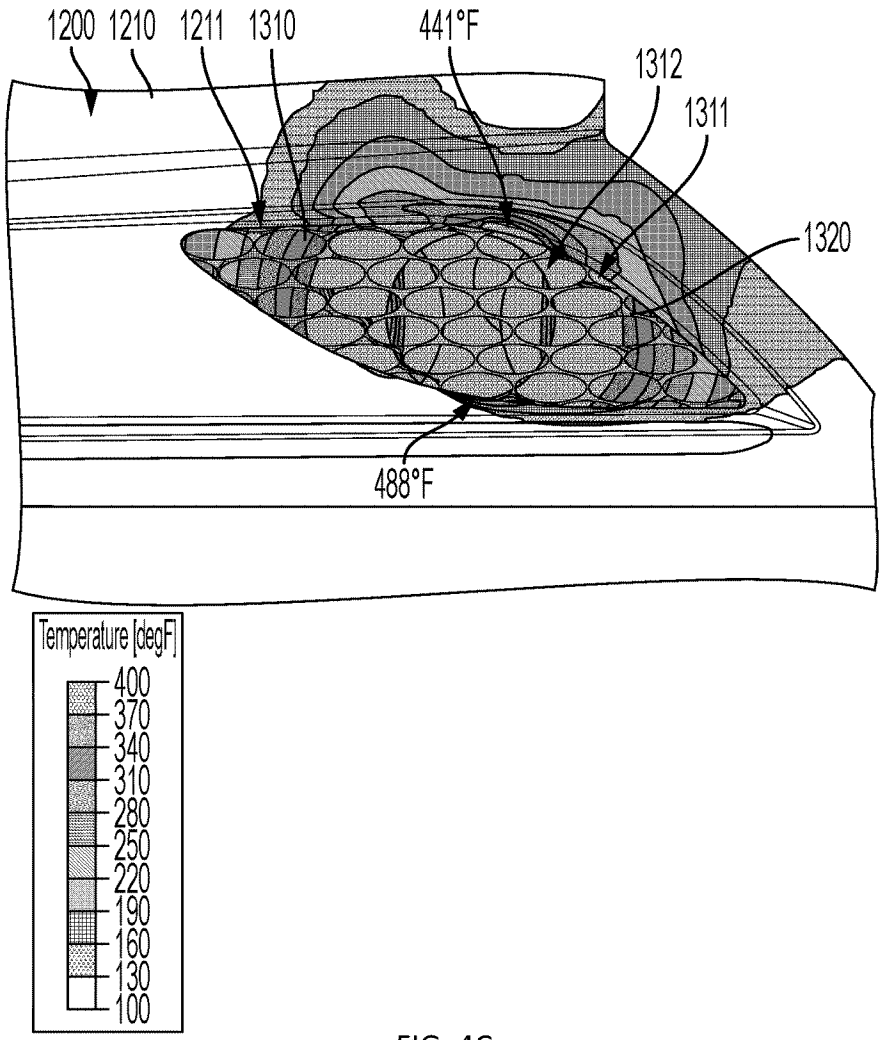
FIG. 4C depicts a heat map of the vehicle of FIG. 4A during the simulation shown in FIG. 4A.

FIGS. 4A-4D illustrate simulations that demonstrate these surprising and unexpected phenomena. FIG. 4A depicts an isothermal thermal surface 1500A of exhaust gas being expelled from the exhaust opening 1211 of the vehicle 1000 when including the expansion chamber 1310 but not the choke plate. FIG. 4B depicts an isothermal thermal surface 1500B of the exhaust gas being expelled from the exhaust opening 1211 of the vehicle 1000 when including both the expansion chamber 1310 and the choke plate 1340. The temperatures of the isothermal surfaces 1500A and 1500B are both 400 degrees Fahrenheit. FIG. 4C depicts a heat map of the vehicle of FIG. 4A during the simulation shown in FIG. 4A. FIG. 4D depicts a heat map of the vehicle of FIG. 4B during the simulation shown in FIG. 4B.

As shown in FIGS. 4A and 4B, the isothermal surface 1500A that occurs when the choke plate is omitted circumscribes a larger area near the exhaust opening 1211 than the isothermal surface 1500B that occurs when the choke plate 1340 is included. The isothermal surface 1500A also extends over portions of the fairing 1210, while the isothermal surface 1500B does not. The isothermal surface 1500B also indicates that, when the choke plate 1340 is included, the exhaust gas and the heat thereof is expelled in a cone-like shape from the exhaust opening 1211, which results from the nozzle effect provided by the expansion chamber 1310 and the choke plate 1340. In contrast, the isothermal surface 1500A indicates that, when the choke plate is not included, the heat flow from the exhaust gas to the fairing 1210 causes higher temperatures in the fairing 1210 compared to when the choke plate 1340 is included.

Referring now to FIGS. 4C and 4D, it can be seen that, when the choke plate 1340 is omitted, the heat flowing from the exhaust gas to the fairing 1210 causes significantly higher temperatures to occur in the portion of the fairing 1210 around the exhaust opening 1211 compared to when the choke plate 1340 is included. Thus, by including the choke plate 1340 together with the expansion chamber 1310, heat flow from the exhaust gas to the fairing 1210 can be better controlled such that the occurrence of high temperatures in the fairing that cause damage and/or discoloration can be prevented or reduced.

Additionally, it can be advantageous to provide the choke plate 1340 as a separate component from (as opposed to integrally formed with) the expansion chamber 1310. This is because different vehicles may have differently shaped and sized exhaust openings. However, it can be advantageous to provide the choke plate 1340 with a shape and size based on the shape and size of the exhaust opening 1211. For example, providing the choke plate 1340 with the opening 1341 having a shape corresponding to the shape of the exhaust opening 1211, while having a smaller cross-sectional area than the cross-sectional area of the exhaust opening 1211, can enhance control of heat flow from the exhaust gas to the fairing 1210 and help to reduce or prevent the occurrence of excessively high temperatures in the fairing 1210. Accordingly, by making the choke plate 1340 as a separate component from the expansion chamber 1310, a single manufacturing design can be used for manufacturing the expansion chamber 1310, while the manufacturing design of the choke plate 1340 can be customized based on the exhaust opening of the vehicle for which the exhaust assembly 1300 is to be used with. This can reduce the cost and complexity of manufacturing the exhaust assembly 1300 compared to if the choke plate 1340 were integrally formed with the expansion chamber 1310 (which would require customization of the larger component that integrally includes both the choke plate and the expansion chamber).

Referring again to FIGS. 1A-3, the choke plate 1340 may include a material having a low thermal conductivity, such as a ceramic material. In some examples, the thermal conductivity of the material of the choke plate 1340 may be lower than the thermal conductivity of the fairing 1210 and/or than the expansion chamber 1310.

In some examples, the choke plate 1340 may have a planar geometry extending over the second opening 1312 when the choke plate 1340 is attached to the expansion chamber 1310. For example, at least the portion of the choke plate 1340 that covers at least part of the second opening 1312 may be a planar sheet of material. In some examples, the choke plate 1340 is positioned entirely outside of the expansion chamber 1310. For example, no portion of the choke plate 1340 extends through the second opening 1312 and into the interior of the expansion chamber 1310 in some examples.

In some examples the exhaust assembly 1300 is separated from the fairing 1210 by a gap 1400 (e.g., an air gap). For example, a surface of the choke plate 1340 facing the fairing 1210 and the exhaust opening 1211 may be separated from the fairing 1210 by the gap 1400. In some examples, the exhaust assembly 1300 (e.g., the choke plate 1340 of the exhaust assembly 1300) does not directly contact the fairing 1210. In some examples, an insulation material (e.g., a closed-loop shaped of insulation material) may be positioned in the gap 1400 between (e.g., directly between) the choke plate 1340 and the fairing 1210. The insulation material may have a lower thermal conductivity than the material of the fairing 1210 and, in some examples, than the material of the choke plate 1310.

The gap 1400 between the exhaust assembly 1300 and the fairing 1210 may provide thermal insulation between exhaust assembly 1300 and the fairing 1210 such that heat transfer to the fairing 1210 from the exhaust gas being expelled is reduced. As explained above, the exhaust assembly 1300 may provide a nozzle effect, whereby the exhaust gas comes into contact with the choke plate 1340 but substantially does not come into contact with the fairing 1210 while being expelled through the exhaust opening 1211. Therefore, while heat may flow from the exhaust gas to the choke plate 1340, subsequent transfer of the heat from the choke plate 1340 to the fairing 1210 can be impeded by the gap 1400 between the choke plate 1340 and the fairing 1210. In addition, by not connecting the exhaust assembly 1300 directly to fairing 1210, the fairing may be made retractable (e.g., moveable to allow easier access to components of the vehicle behind the fairing 1210).

The grill plate 1320 may span across the second opening 1312. The grill plate 1320 may be integral with, or non-integral with, the expansion chamber 1310. For example, the grill plate 1320 may be attachable to, and detachable from, the expansion chamber 1310, and may be attached to the expansion chamber 1310 during the manufacturing of the exhaust assembly 1300. The grill plate 1320 may include a material that is the same as, or different from, a material of the expansion chamber 1310. In some examples, the grill plate 1320 has a grid pattern or a mesh pattern. The grill plate 1320 can block unwanted objects from entering into, or being placed in, the exhaust pipe 1100 and the expansion chamber 1310. For example, the grill plate 1320 can prevent small animals and blowing objects from entering the expansion chamber 1310. Additionally, the grill plate 1320 can provide an aesthetically appealing appearance to the exhaust opening 1211.

The thermal barrier layer 1330 may be positioned between the choke plate 1340 and the expansion chamber 1310. The thermal barrier layer 1330 can block or impede heat from flowing from the exhaust gas to the choke plate 1340 and, thus, can further reduce the amount of heat flowing to the fairing 1210 from the choke plate 1340. For example, the thermal barrier layer 1330 may include (e.g., be) a material having a lower thermal conductivity than the material of the choke plate 1340 and/or than the material of the expansion chamber 1310. In some examples, the thermal barrier layer 1330 includes (e.g., is) a ceramic or fiberglass material. Thus, the thermal barrier layer 1330 can further protect the fairing 1210 from degradation and damage caused by excessively high temperatures.

In some examples, the thermal barrier layer 1330 may have a shape corresponding to the shape of the choke plate 1340. For example, the choke plate 1340 may have the opening 1341, and the thermal barrier layer 1330 may have an opening 1331 having a shape corresponding to (e.g., being the same as) a shape of the opening 1341 of the choke plate 1340. In some examples, the size (e.g., cross-sectional area) of the opening 1331 of the thermal barrier layer 1330 may be the same as, smaller than, or larger than, the size of the opening 1341 of the choke plate 1340.

The thermal barrier layer 1330 may have a planar geometry and may extend over at least part of the second opening 1312. In some examples, the thermal barrier layer 1330 is positioned entirely outside of the expansion chamber 1310. For example, no portion of the thermal barrier layer 1330 extends through the second opening 1320 and into the interior of the expansion chamber 1310 in some examples.

The thermal barrier layer 1330 and the choke plate 1340 may be separate components. In some other examples, the thermal barrier layer 1330 forms a part of the choke plate 1340. For example, the thermal barrier layer 1330 may be a layer of insulation material coated onto a side of the choke plate 1340 facing (or configured to face) the expansion chamber 1310.

In some examples, the exhaust pipe 1100 may include at least one diffusion inlet 1120, which exposes the interior of the exhaust pipe 1100 to the exterior of the exhaust pipe 1100 and is configured to allow air to be mixed with the exhaust gas as it is expelled out from the exhaust pipe 1100. Because the air outside of the exhaust pipe 1100 is generally colder than the exhaust gas, adding and mixing the outside air into the exhaust gas can lower the average temperature of the exhaust gas. Therefore, heat transfer from the exhaust gas to the fairing 1210 may be reduced compared to examples where the at least one diffusion inlet 1120 is omitted.

The at least one diffusion inlet 1120 may include an even number of (e.g., two) diffusion inlets including one or more pairs of diffusion inlets, each of the one or more pairs of diffusion inlets being on opposite sides of the exhaust pipe 1100. In some examples, the at least one diffusion inlet 1120 includes three or more diffusion inlets that are arranged around the exhaust pipe 1100 in a ring shape. Each of the diffusion inlets 1120 may include a surface extending from the exterior of the exhaust pipe 1100 inwardly into the exhaust pipe so that the colder external air is generally pulled into the exhaust pipe 1100 via a siphon-like effect.

In some examples, one or more diffusion inlets may be provided in the expansion chamber 1310 instead of, or together with, the at least one diffusion inlet 1120 in the exhaust pipe 1100. For example, the one or more diffusion inlets of the expansion chamber 1310 may be provided in a side of the expansion chamber 1310 opposite to the second opening 1312 and/or that faces away from the exhaust opening 1211. For example, the one or more diffusion inlets of the expansion chamber 1310 may be in a same side of the expansion chamber 1310 as the first opening 1311. The one or more diffusion inlets of the expansion chamber 1310 may be openings (e.g., holes) exposing the interior of the expansion chamber 1310 from outside the expansion chamber 1310. The one or more diffusion inlets of the expansion chamber 1310 can allow cold air to be mixed into the exhaust gas in the expansion chamber 1310 in a similar manner as the at least one diffusion inlet 1120 of the exhaust pipe 1100.

The exhaust pipe 1100 may be supported within the body 1200 of the vehicle 1000 by one or more fastening devices, including, for example, a first fastening device 1110. The one or more fastening devices may be configured to keep the exhaust pipe 1100 suspended within the body 1200 and with the distal end of the exhaust pipe 1100 aligned with the exhaust opening 1211. The exhaust assembly 1300 may be fixedly attached to the distal end of the exhaust pipe 1100 such that the exhaust assembly 1300 generally does not move relative to the exhaust pipe 1100.

Although examples of vehicles including an exhaust assembly have been described herein, the present disclosure is not limited thereto. For example, the present disclosure also encompasses examples of exhaust assemblies as a separate device (e.g., separate from vehicles that they are configured to be included in).

Although specific examples are described herein, the scope of the technology is not limited to those specific examples. Moreover, while different examples may be described separately, such examples may be combined with one another in implementing the technology described herein. One skilled in the art will recognize other examples or improvements that are within the scope and spirit of the present technology. Therefore, the specific examples are disclosed only as illustrative examples, and the present disclosure is not limited thereto. The scope of the technology is defined by the following claims and any equivalents therein.

What is claimed is:

1. A vehicle, comprising:

an engine;

an exhaust pipe, fluidly coupled to the engine;

a vehicle body comprising a fairing having an exhaust opening; and an exhaust assembly, the exhaust assembly comprising:

an expansion chamber having a first opening fluidly coupled to the exhaust pipe and a second opening aligned with the exhaust opening in the fairing, a cross-sectional area of the second opening being greater than a cross-sectional area of the first opening, and a choke plate attached to the expansion chamber and shaped and sized to cover at least ten percent of the cross-sectional area of the second opening.

2. The vehicle of claim 1, wherein the choke plate has a planar geometry extending over the second opening.

3. The vehicle of claim 1, wherein the choke plate is positioned entirely outside of the expansion chamber.

4. The vehicle of claim 1, wherein the choke plate has an opening aligned with, and having a shape generally corresponding to, the exhaust opening in the fairing.

5. The vehicle of claim 1, wherein the fairing covers at least part of an outer edge of the choke plate.

6. The vehicle of claim 1, wherein the exhaust assembly is separated from the fairing by a gap.

7. The vehicle of claim 1, wherein the exhaust assembly further comprises a thermal barrier between the choke plate and the expansion chamber.

8. The vehicle of claim 1, wherein the exhaust assembly further comprises a grill plate spanning across the second opening.

9. A vehicle, comprising:

an engine;

an exhaust pipe, fluidly coupled to the engine;

a vehicle body comprising a fairing having an exhaust opening; and an exhaust assembly, the exhaust assembly comprising:

an expansion chamber having a first opening coupled to the exhaust pipe and a second opening aligned with the exhaust opening in the fairing, a cross-sectional area of the second opening being greater than a cross-sectional area of the first opening, a grill plate spanning across the second opening, and a choke plate attached to the expansion chamber and shaped and sized to cover at least part of the second opening.

10. The vehicle of claim 9, wherein the choke plate has a planar geometry extending over the second opening, and is entirely outside of the expansion chamber.

11. The vehicle of claim 9, wherein the choke plate has an opening aligned with, and having a shape generally corresponding to, the exhaust opening in the fairing.

12. The vehicle of claim 9, wherein the fairing covers at least part of an outer edge of the choke plate.

13. The vehicle of claim 9, wherein the exhaust assembly is separated from the fairing by a gap.

14. The vehicle of claim 9, wherein the exhaust assembly further comprises a thermal barrier between the choke plate and the expansion chamber.

15. An exhaust assembly for a vehicle, the exhaust assembly comprising:

an expansion chamber having a first opening configured to be coupled to an exhaust pipe and a second opening having a cross-sectional area that is greater than a cross-sectional area of the first opening;

a choke plate attached to the expansion chamber and shaped and sized to cover at least part of the second opening; and a thermal barrier layer between the choke plate and the expansion chamber.

16. The exhaust assembly of claim 15, wherein the choke plate covers at least ten percent of the cross-sectional area of the second opening, and the choke plate has an opening exposing the remainder of the cross-sectional area of the second opening.

17. The exhaust assembly of claim 15, wherein the thermal barrier layer is shaped and sized to cover at least part of the second opening.

18. The exhaust assembly of claim 15, further comprising a grill plate spanning across the second opening.

19. The exhaust assembly of claim 15, wherein the second opening of the expansion chamber has a quadrangular shape.

20. The exhaust assembly of claim 15, wherein the choke plate has a planar geometry extending over the second opening, and is positioned entirely outside of the expansion chamber.

* * * * *